US009577387B2

(12) United States Patent
Hu et al.

(10) Patent No.: US 9,577,387 B2
(45) Date of Patent: Feb. 21, 2017

(54) ELECTRICAL CONNECTOR HAVING A GROUND TERMINAL WITH CONTACT PORTIONS IN CONTACT WITH A SHIELDING SHEET

(71) Applicant: LOTES CO., LTD, Keelung (TW)

(72) Inventors: Jin Ke Hu, Keelung (TW); Wen Chang Chang, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 15/156,746

(22) Filed: May 17, 2016

(65) Prior Publication Data

US 2016/0352050 A1 Dec. 1, 2016

(30) Foreign Application Priority Data

May 26, 2015 (CN) ..... 2015 2 0344363 U
Aug. 14, 2015 (CN) ..... 2015 2 0610121 U

(51) Int. Cl.

*H01R 13/648* (2006.01)
*H01R 13/6594* (2011.01)
*H01R 13/652* (2006.01)
*H01R 24/60* (2011.01)
*H01R 13/6597* (2011.01)

(52) U.S. Cl.

CPC ..... *H01R 13/6594* (2013.01); *H01R 13/648* (2013.01); *H01R 13/652* (2013.01); *H01R 13/6597* (2013.01); *H01R 24/60* (2013.01)

(58) Field of Classification Search

CPC ..... H01R 4/66; H01R 13/648; H01R 13/652; H01R 13/658; H01R 13/6594; H01R 13/6597; H01R 13/65802; H01R 24/60
USPC ..... 439/607.01–607.54, 108
See application file for complete search history.

(56) References Cited

U.S. PATENT DOCUMENTS 6,247,967 B1 * 6/2001 Wu ..... H01R 12/721 439/607.01
7,578,701 B2 * 8/2009 Hsu ..... H01R 23/6873 439/607.34
8,506,330 B2 * 8/2013 Mizukami ..... H01R 13/648 439/607.07
2011/0189892 A1 * 8/2011 Mizukami ..... H01R 13/648 439/607.34
2015/0244111 A1 * 8/2015 Ju ..... H01R 13/6585 439/607.05
2016/0104975 A1 * 4/2016 Guo ..... H01R 13/6585 439/607.05
2016/0149348 A1 * 5/2016 Kao ..... H01R 13/6585 439/607.05
2016/0149350 A1 * 5/2016 Kao ..... H01R 24/60 439/607.05

* cited by examiner

*Primary Examiner* — Chandrika Prasad
(74) *Attorney, Agent, or Firm* — Locke Lord LLP; Tim Tingkang Xia, Esq.

(57) ABSTRACT

An electrical connector includes an insulating body, a shielding sheet disposed in the insulating body, and a ground terminal received in the insulating body for mating with a mating connector. The ground terminal is fixed between a plate surface of the shielding sheet and the insulating body. The ground terminal includes a front end, a middle section, and a rear end having a soldering portion. A first contacting portion is disposed at the front end, a second contacting portion is disposed at the middle section, and the first contacting portion and the second contacting portion respectively electrically contact with the shielding sheet.

10 Claims, 7 Drawing Sheets

100

ELECTRICAL CONNECTOR HAVING A GROUND TERMINAL WITH CONTACT PORTIONS IN CONTACT WITH A SHIELDING SHEET

CROSS-REFERENCE TO RELATED APPLICATION

This non-provisional application claims priority to and benefit of, under 35 U.S.C. §119(a), Patent Application Nos. 201520344363.7 and 201520610121.8 filed in P.R. China on May 26, 2015 and Aug. 14, 2015, respectively, the entire contents of which are hereby incorporated by reference.

FIELD OF THE INVENTION

The present invention relates to an electrical connector, in particular to an electrical connector with a good high frequency transmission performance.

BACKGROUND OF THE INVENTION

A USB electrical connector in an existing TYPE C standard generally includes an insulating body. Upper and lower two rows of terminals are disposed at upper and lower two sides of the insulating body. Each row of terminals include differential signal terminals for transmitting a high frequency signal and grounding terminals. A shielding sheet is further embedded into the insulating body and located between the upper and lower two rows of terminals. By the middle shielding sheet, noise and crosstalk between the upper and lower two rows of terminals are conducted to a grounding path on the circuit board so as to isolate interference between the two rows of terminals. However, an effect of connecting to a circuit board for grounding and conducting by the shielding sheet is limited, the interference among the terminals cannot be effectively reduced and interference such as the noise and crosstalk cannot be reduced to the minimum.

Therefore, a heretofore unaddressed need exists in the art to address the aforementioned deficiencies and inadequacies.

SUMMARY OF THE INVENTION

In one aspect, the present invention relates to an electric connector with a good high frequency transmission performance.

In one embodiment, an electrical connector includes an insulating body, a shielding sheet disposed in the insulating body, and a ground terminal received in the insulating body. The ground terminal is in corresponding contact with a mating connector, and fixed between a plate surface of the shielding sheet and the insulating body. The ground terminal has a front end, a middle section, and a rear end having a soldering portion. The front end and the middle section of the ground terminal are respectively provided with a first contacting portion and a second contacting portion. The first contacting portion and the second contacting portion respectively electrically contact with the shielding sheet.

In one embodiment, the shielding sheet is provided with a first urging portion and a second urging portion extending toward the ground terminal, for respectively urging against and contact with the first contacting portion and the second contacting portion.

In one embodiment, the middle section of the ground terminal includes a horizontal segment and a vertical segment perpendicular to each other, and the horizontal segment and the vertical segment are each provided with one second contacting portion. The shielding sheet includes a plate body portion and an extending portion which are respectively parallel with the horizontal segment and the vertical segment. The plate body portion and the extending portion are each provided with one second urging portion correspondingly urging against the second contacting portions on the horizontal segment and the vertical segment.

In one embodiment, the shielding sheet is formed by punching a metal plate material. The first urging portion and the second urging portion are formed by puncturing the metal plate material to each have a cantilever shape. The first urging portion and the second urging portion are in corresponding plate surface contact with the first contacting portion and the second contacting portion.

In one embodiment, a soldering leg extends from a back end of the shielding sheet and is adjacent to the soldering portion of the ground terminal.

In certain embodiments, a row of terminals are arranged above or below the plate surface of the shielding sheet. The two terminals located at the outermost side in the row of terminals are ground terminals. The shielding sheet correspondingly urges against the first contacting portion and the second contacting portion of each ground terminal. Two soldering legs extend from the back end of the shielding sheet, and the two soldering legs are respectively located at the outer sides of the soldering portions of the two ground terminals.

In certain embodiments, the insulating body is disposed with an upper row of terminals and a lower row of terminals. The shielding sheet is located between the upper and lower two rows of terminals. Each row of terminals include the ground terminal. The front end and middle section of the upper ground terminal are respectively provided with a first contacting portion and a second contacting portion which electrically contact with the shielding sheet. The middle section of the lower ground terminal is provided with a third contacting portion electrically contacting with the shielding sheet. The middle section of the upper ground terminal is provided with two second contacting portions. Two second urging portions extend from the shielding sheet, and respectively contact with the two second contacting portions. The shielding sheet further has a third urging portion urging against the third contacting portion, and the third urging portion is located between the two second urging portions.

In one embodiment, the middle section of the ground terminal in the lower row of terminals is provided with a third contacting portion electrically contacting with the shielding sheet.

In one embodiment, the middle section of the ground terminal in the upper row of terminals is provided with two second contacting portions, the shielding sheet extends two second urging portions respectively contacting with the two second contacting portions, the shielding sheet further includes a third urging portion urging against the third contacting portion, and the third urging portion is located between the two second urging portions.

Compared with related art, certain embodiments of the present invention have the following beneficial advantages. The first contacting portion and the second contacting portion disposed at the front end and middle section of the same ground terminal respectively urge the shielding sheet, thus forming a multiple signal return paths between the ground terminal and the shielding sheet, enhancing a grounding effect of the electrical connector and improving a high frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
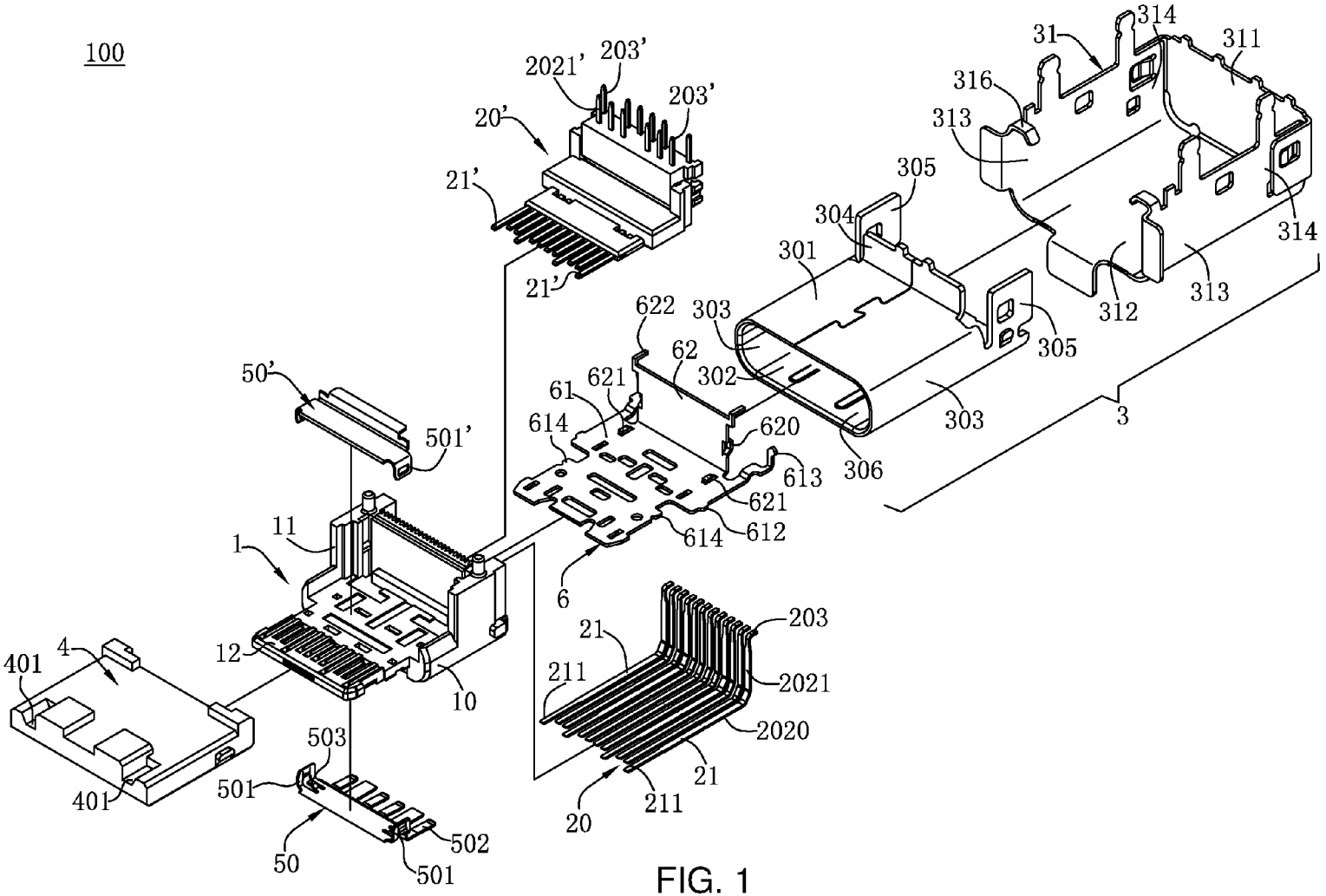
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

As shown in FIGS. 1-4, in certain embodiments, the electrical connector 100 is mounted on a circuit board 7. The electrical connector 100 includes an insulating body 1, multiple terminals 2, a shielding sheet 6, and a shielding casing 3. The multiple terminals 2 are divided into an upper row of terminals 20 and a lower row of terminals 20' fixedly arranged at the insulating body 1. The shielding sheet 6 is disposed at the insulating body 1 and positioned between the upper row of terminals 20 and the lower row of terminals 20'. The shielding casing 3 is framed outside the insulating body 1.

Figure 2:
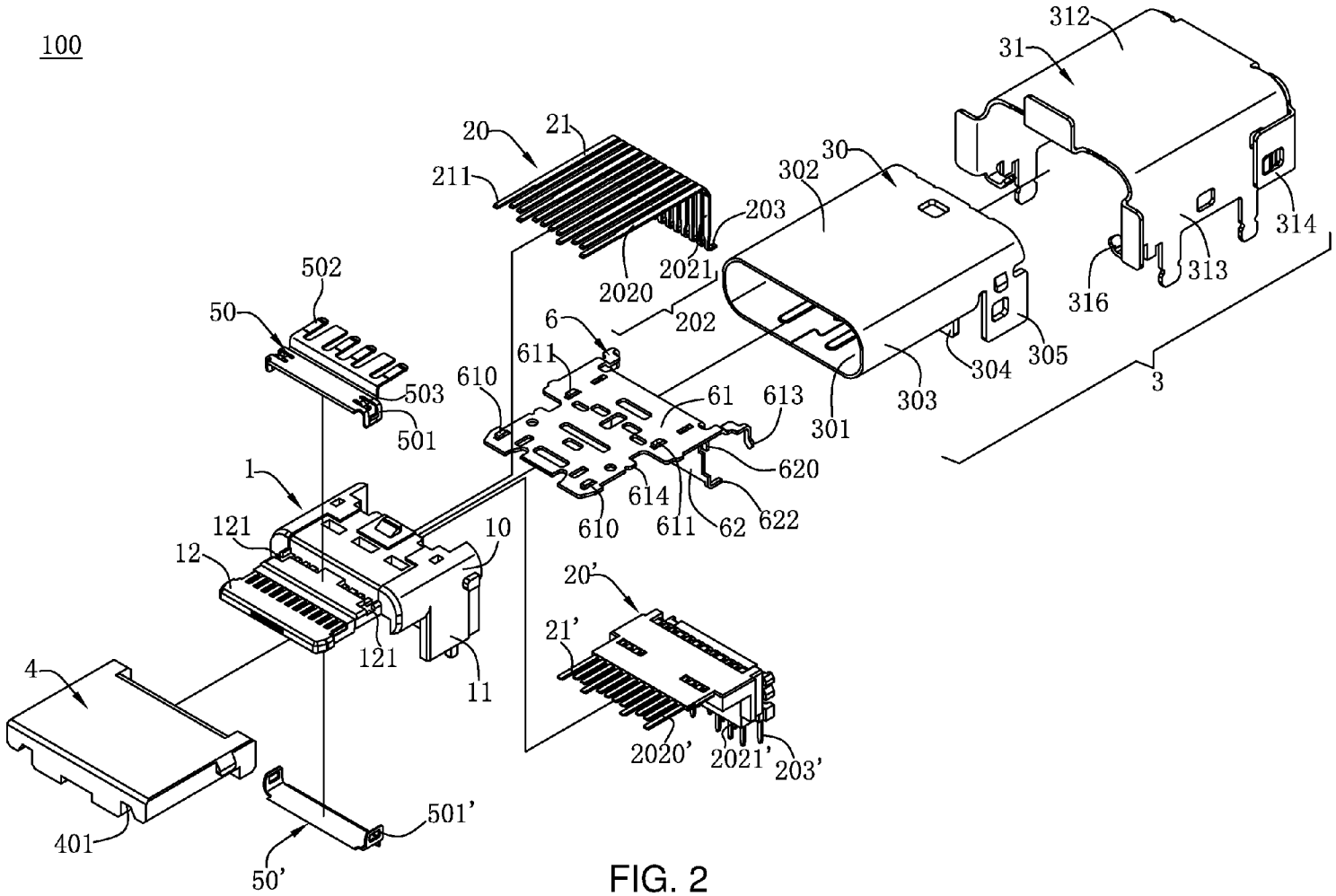
FIG. 2 is a schematic three-dimensional exploded view of the electrical connector according to one embodiment of the present invention from another angle.
Figure 5:
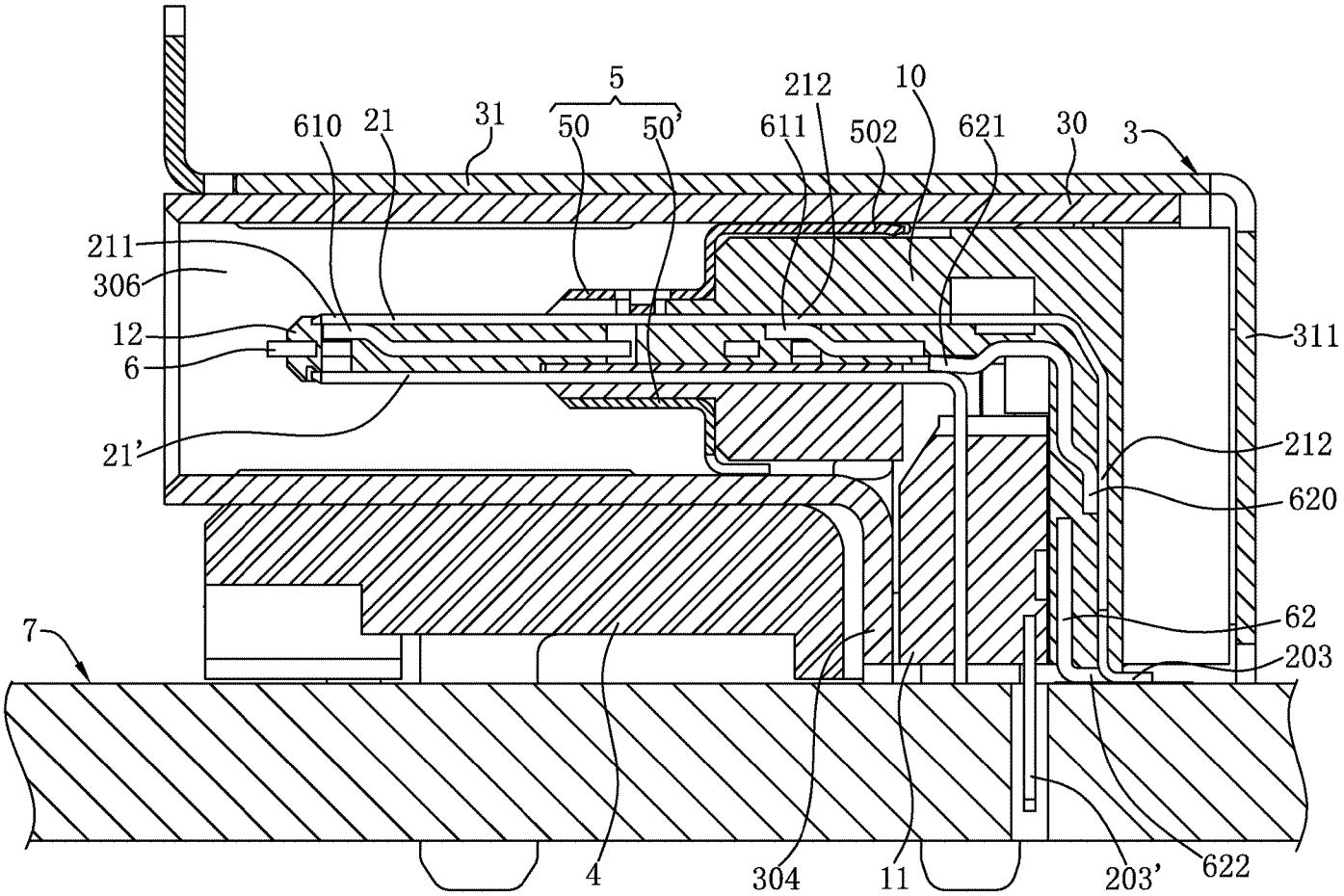
FIG. 5 is a schematic side sectional view of an electrical connector according to one embodiment of the present invention.

As shown in FIGS. 2 and 5, the insulating body 1 includes a base 10 and a tongue 12 protruding and extending forward from the base 10. A heightening portion 11 integrally extends downward from the base 10.

As shown in FIGS. 1 and 2, the upper row of terminals 20 and the lower row of terminals 20' respectively include 12 terminals. The upper row of terminals 20 and the lower row of terminals 20' are opposite in left and right arrangement sequence, and symmetric in upper and lower arrangement sequence, and same in transmitting signal. The upper row of terminals 20 are arranged in sequence from left to right and are sequentially a ground terminal (GND) 21, a differential signal high speed transmitting terminal pair (TX1+, TX1−, namely a USB3.0 terminal), a power source terminal (Vbus), a reserved terminal (CC1), a USB 2.0 differential terminal pair (Dp1, Dn1), a reserved terminal (SBU1), a power terminal (Vbus), a differential signal high speed receiving terminal pair (RX2+, RX2−) and a ground terminal (GND)21. The lower row of terminals 20' are arranged in sequence from right to left and are sequentially a ground terminal (GND) 21', a differential signal high speed receiving terminal pair (TX2+, TX2−, namely a USB3.0 terminal), a power source terminal (Vbus), a reserved terminal (CC2), a USB 2.0 differential terminal pair (Dp2, Dn2), a reserved terminal (SBU2), a power terminal (Vbus), a differential signal high speed receiving terminal pair (RX1+, RX1−) and a ground terminal (GND)21', so that the electrical connector 100 can be inserted in dual orientation.

Figure 6:
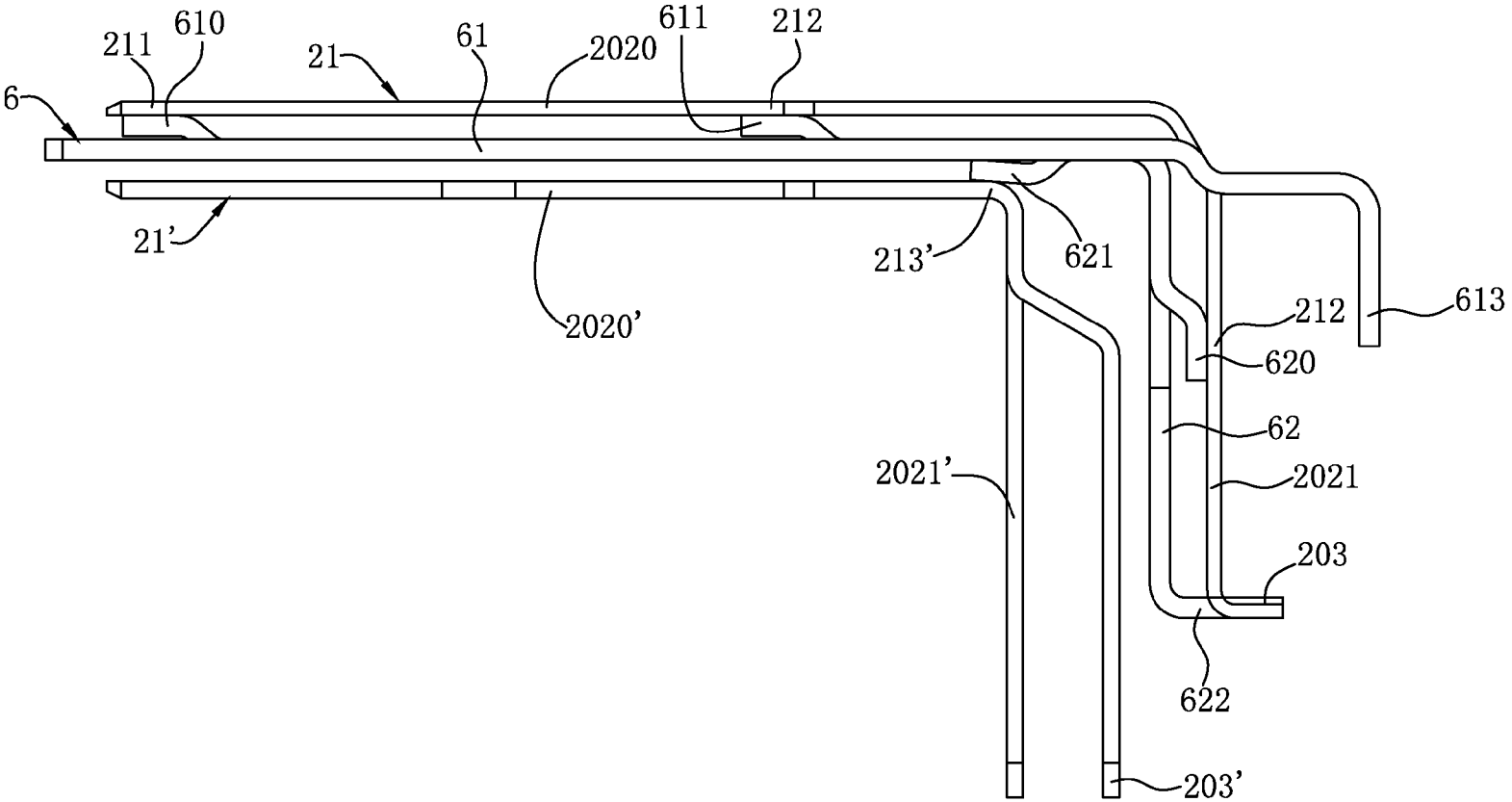
FIG. 6 is a schematic view of upper and lower rows of terminals and a shielding sheet in FIG. 5.
Figure 7:
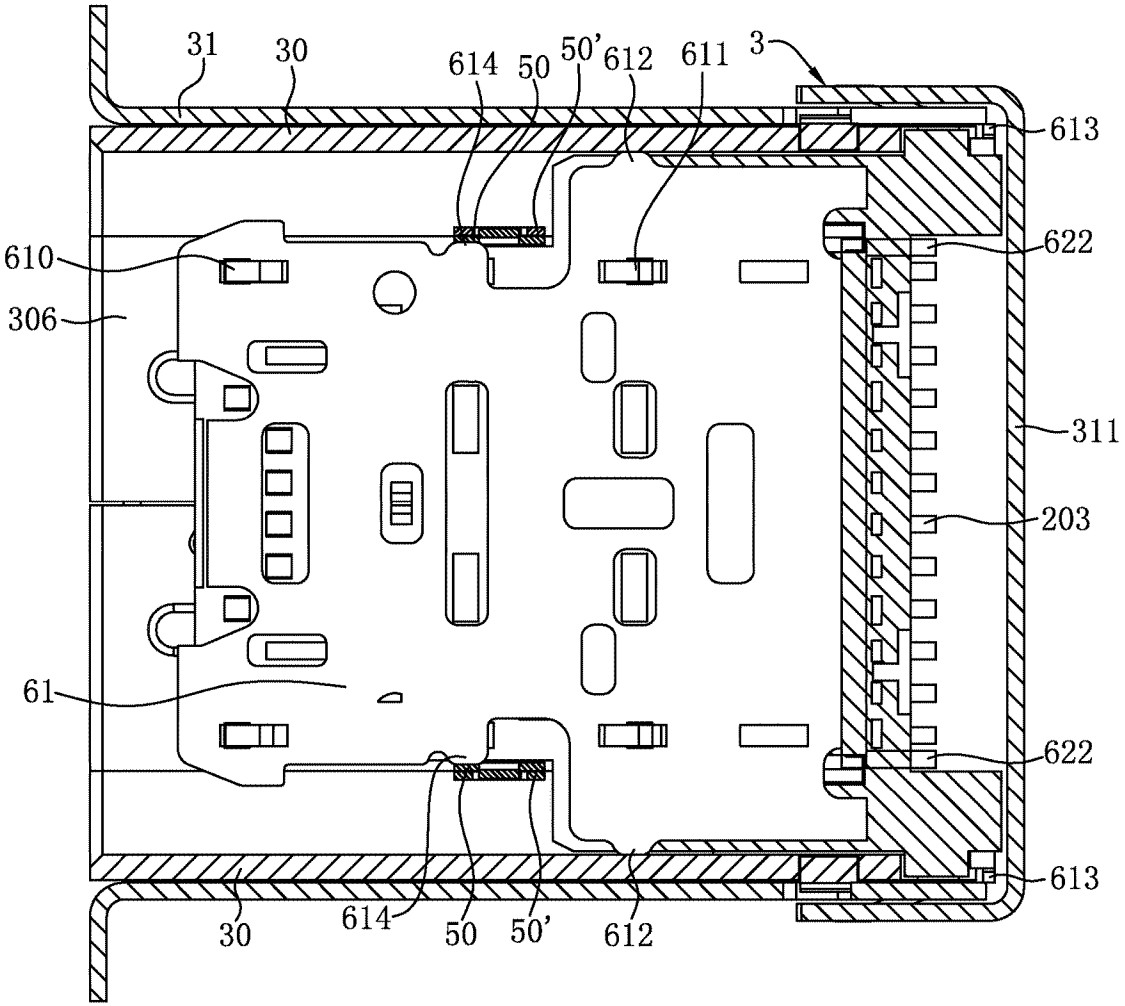
FIG. 7 is a top sectional view of an electrical connector according to one embodiment of the present invention.

As shown in FIGS. 2, 5 and 6, each terminal in the upper row of terminals 20 and the lower row of terminals 20' is disposed between a plate surface of the shielding sheet 6 and the insulating body 1. The front portion of each terminal is fixedly to the tongue 12 and is partially exposed out of the surface of the tongue 12 to be in contact with a mating connector. The middle section of the terminal is located in the heightening portion 11. The terminals further include soldering portions 203 and 203' which extend backward from the middle section and out of the heightening portion 11. The soldering portions 203 and 203' are used for being welded to the circuit board 7. The soldering portions 203 of the upper row of terminals 20 are in an SMT type and are arranged in a row, the soldering portions 203' of the lower row of terminals 20' are in a DIP type and are staggered front and back to be arranged into two rows. The soldering portions 203 and 203' of the ground terminals 21 and 21' are soldered to a grounding path on the circuit board 7.

The front end and middle section of each of the upper ground terminals 21 are respectively disposed with a first contacting portion 211 and a second contacting portion 212. The first contacting portions 211 and the second contacting portions 212 are electrically contact with the shielding sheet 6. Specifically, the front end of each of the ground terminals 21 is provided with one first contacting portion 211. The middle section of each of the ground terminals 21 is approximately L-shaped and includes a horizontal segment 2020 and a vertical segment 2021 perpendicular to each other. The horizontal segment 2020 and the vertical segment 2021 are respectively provided with one second contacting portion 212. The soldering portions 203 at the rear end of the upper ground terminals 21 are in the SMT type.

The lower ground terminals 21' are approximately similar in structure. The middle section of each lower ground terminal 21' is approximately L-shaped and includes a horizontal segment 2020' and a vertical segment 2021' perpendicular to each other. The lower ground terminal 21' is only provided with a third contacting portion 213' at the middle section, which is particularly located at a rear location on the horizontal segment 2020'. In addition, the soldering portions 203' of the lower ground terminals 21' are in the DIP type.

Figure 4:
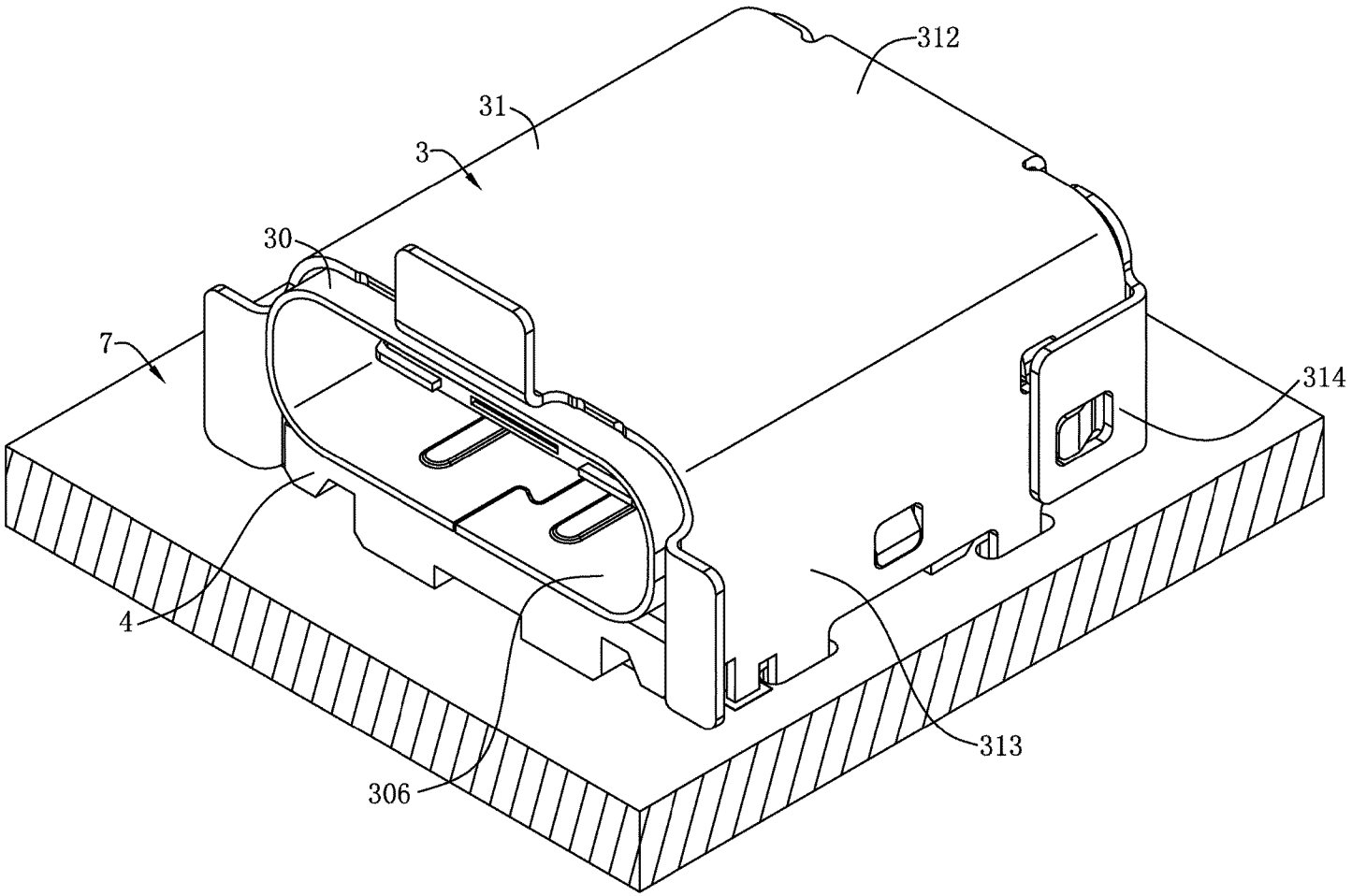
FIG. 4 is a schematic three-dimensional assembled view of an electrical connector according to one embodiment of the present invention.

As shown in FIGS. 2, 4 and 5, the shielding casing 3 includes a bottom wall 301, a top wall (no labeled) and two side walls (not labeled) connected with the bottom wall 301 and the top wall. The top wall, the bottom wall 301 and the two side walls encircle the tongue 12 to form a plug interface 306. The heightening portion 11 is lower than the plug interface 306. The bottom wall 301 integrally bends downward from back end of the bottom wall 301 and extends to form a shielding plate 304. The shielding plate 304 is located in front of the heightening portion 11 and partially shields the heightening portion 11. The top wall integrally bends downward from the back end of the top wall and extends to form a rear cover 311. The rear cover 311 is located behind the heightening portion 11 and at least partially shields the heightening portion 11. Therefore, the middle sections of the terminals are disposed between the shielding plate 304 and the rear cover 311. In addition, two baffles (not labeled) extend from the two side walls and are respectively located at two sides of the heightening portion 11. The shielding plate 304, the rear cover 311 and the two baffles encircle the middle sections therein. When the electrical connector 100 is soldered to the circuit board 7, the shielding plate 304, the rear cover 31 and the two baffles isolate the middle sections from an external environment, so that the electrical connector 100 is free of influence by electro-magnetic interference (EMI) during transmission of a high frequency signal, thus improving a high frequency transmission performance of the electrical connector 100. In certain embodiments, the shielding plate 304, the rear cover 311 or the baffles are provided with soldering legs (not labeled) for being soldered on the circuit board 7 to enhance a shielding effect of the electrical connector 100.

As shown in FIGS. 1, 2 and 4, in certain embodiments, the shielding casing 3 includes a first shielding casing 30 and a second shielding casing 31, and the second shielding casing 31 wraps the outer side of the first shielding casing 30. The first shielding casing 30 has the bottom wall 301, a first top wall 302 and two first side walls 303. The bottom wall 301, the first top wall 302 and two first side walls 303 encircle the tongue 12 to form the plug interface 306. The shielding plate 304 integrally bends and extends downward from the bottom wall 301 of the first shielding casing 30 to block in front of the heightening portion 11. The two first side walls 303 respectively extend to form the first baffles 305 located at two sides of the heightening portion 11. The second shielding casing 31 has a second top wall 312 and two second side walls 313 formed by extending from two sides of the second top wall 312. The top wall includes a first top wall 302 and a second top wall 312, the side walls include a first side wall 303 and a second side wall 313, and the second top wall 312 and the second side wall 313 are respectively attached to the outer sides of the first top wall 302 and the first side wall 303. The rear cover 311 integrally bends and extends downward from the back of the second top wall 312 to block behind the heightening portion 11. The baffles include a first baffle 305 and a second baffle 314. The second baffle 314 is formed by extending from the second side wall 313 and is attached to the outer side of the first baffle 305. The soldering legs (not labeled) are disposed at the second baffle 314.

In certain embodiments, a cushion block 4 is disposed below the bottom wall 301. The cushion block 4 corresponds to the heightening portion 11 to fill a gap below the plug interface 306, above the circuit board 7 and in front of the heightening portion 11, so that the shielding plate 304 is clamped between the heightening portion 11 and the cushion block 4 to prevent the electrical connector 100 from tilting forward due to plugging and unplugging for many times, and a service life is prolonged. A clamp hook 316 is disposed at the front end of the second side wall 313, the cushion block 4 is correspondingly provided with a notch 401, and the clamp hook 316 is buckled to the notch 401 to fix the cushion block 4.

Figure 3:
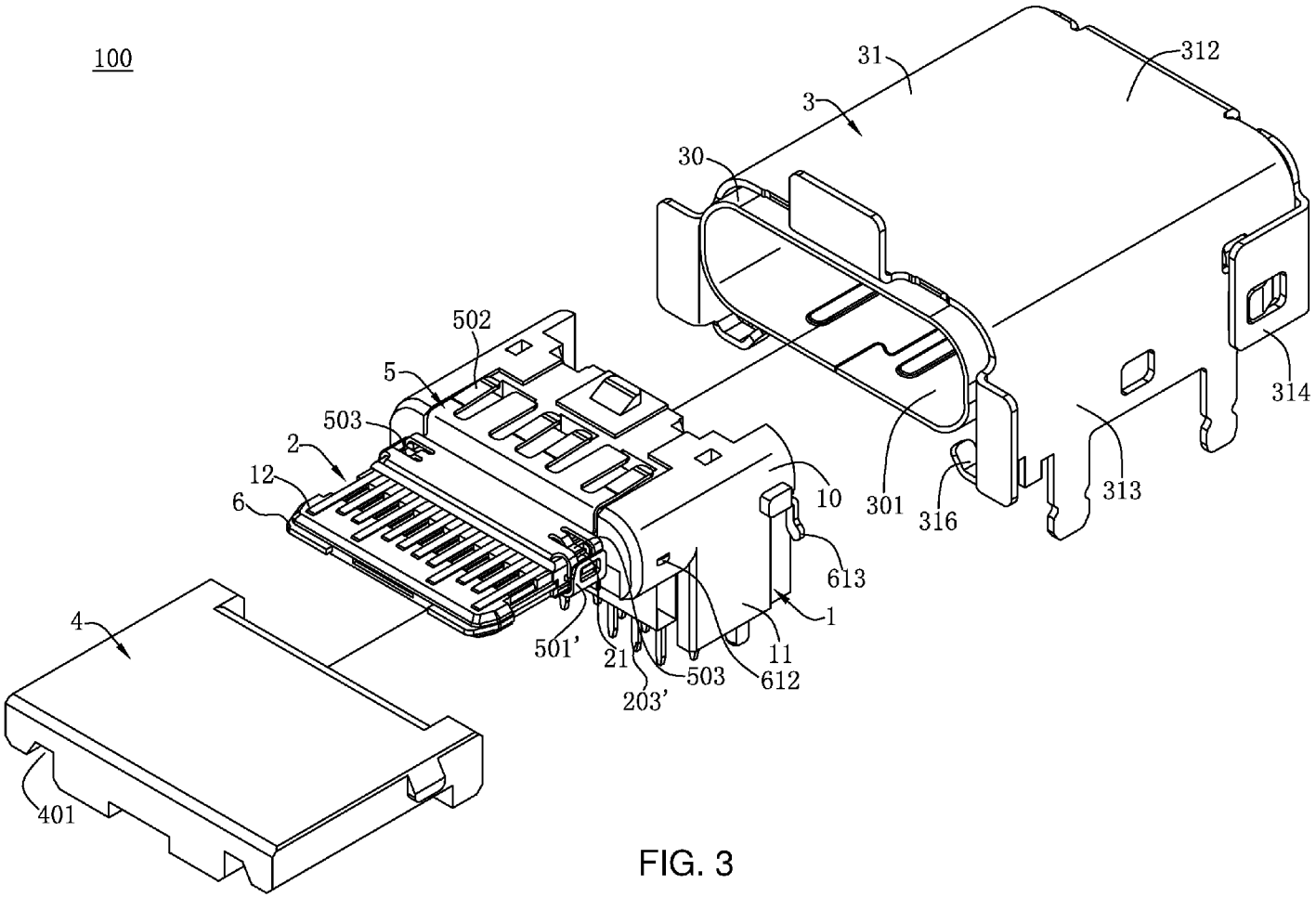
FIG. 3 is a partial three-dimensional exploded view of an electrical connector according to one embodiment of the present invention.

As shown in FIGS. 2 and 3, the electrical connector 100 further includes a shielding cover 5. The shielding cover 5 sleeves the portion of the tongue 12 close to the base 10 and partially extends to the base 10. The shielding cover 5 includes a first shielding cover 50 and a second shielding cover 50', and the first shielding cover 50 and the second shielding cover 50' are buckled and combined with each other by buckling portions 501 and 501' thereon to be fixed at the portion of the tongue 12 close to the base 10. The first shielding cover 50 has an elastic arm 502 located at the base 10 and elastically contacting with the first top wall 302 of the first shielding casing 30 to be grounded. In certain embodiments, two sides of the first shielding cover 50 are transversely provided with two elastic pieces 503, and the portion of the tongue 12 close to the base 10 is provided with avoiding slots 121 corresponding to the elastic pieces 503. The ground terminals 21 and 21' are partially exposed out of the avoiding slot 121, the elastic pieces 503 urge against the ground terminals 21 and 21' via the avoiding slots 121 so as to be grounded, thus enhancing a shielding effect of the electrical connector 100 and improving its high frequency transmission quality. In other embodiments, the elastic pieces 503 can also be arranged at the second shielding cover 50', the shielding cover 5 can be integrally formed and sleeves the tongue 12 from front to back, and is not limited thereto.

As shown in FIGS. 2, 5 and 6, the shielding sheet 6 is formed by punching a metal plate and includes a plate body portion 61 disposed at the tongue 12 and between the front ends and the horizontal segments 2020 and 2020' of the upper row of terminals 20 and the lower row of terminals 20'. An extending portion 62 is formed at back end of the plate body portion 61 by bending and extending downward from the plate body portion 61, extends to the heightening portion 11, and is located between the vertical segments 2021 and 2021' of the upper row of terminals 20 and the lower row of terminals 20'. The plate body portion 61 and the extending portion 62 are respectively parallel with the horizontal segment 2020 and the vertical segment 2021.

The plate body portion 61 and the extending portion 62 are provided with a plurality of urging portions contacting with the ground terminals 21 and 21'. Particularly, below each ground terminal 21, the front location of the plate body portion 61 is punctured from a metal plate to form a first urging portion 610 in a cantilever shape. The first urging portions 610 urge upward against the first contacting portions 211 of the upper ground terminals 21. The rear location of the plate body portion 61 is punctured to form second urging portions 611 urge upward against the second contacting portions 212 on the horizontal segments 2020. The rear location of the plate body portion 61 is downward punctured to form third urging portions 621 urging against the third contacting portions 213' of the lower ground terminals 21'. In certain embodiments, the side edges of the extending portion 62 is punctured to form second urging portions 620 urging against the second contacting portions 212 on the vertical segments 2021 of the upper ground terminals 21, and each of the third urging portions 621 is located between the two second urging portions 611 and 620 along a front and back direction. The urging portions and the ground terminals 21 and 21' are in plate surface contact to increase a contact area between the two. Due to such arrangement, a plurality of signal return paths exist between the ground terminals 21 and 21' and the shielding sheet 6, thus enhancing a grounding effect of the electrical connector 100 and improving its high frequency performance.

In the present embodiment, since the upper row terminals 20 and the lower row terminals 20' are symmetrically arranged, the upper ground terminals 21 and the lower ground terminals 21' correspond to each other in location and are located in the same vertical location, so that only the first urging portion 610 can be punctured from the front end portion of the shielding sheet 6 to contact with the first contacting portion 211 at the front end of the above ground terminal 21. In other embodiments, two first urging portions 610 can be punctured from the front end of the shielding sheet 6 in a front and rear staggering manner and respectively contact with the front ends of the upper ground terminals 21 and the lower ground terminals 21'. The present invention is not limited thereto.

In certain embodiments, two side edges of the plate body portion 61 respectively extend to form a pressing portion (not labeled). The pressing portions include a first pressing portion 612 and a second pressing portion 613, and the second pressing portion 613 is located behind the first pressing portion 612. The first pressing portion 612 protrudes from the base 10 and respectively presses the first side wall 303 and the second wall 313 of the first shielding casing 30. The second pressing portion 613 firstly extends backward to the base 10 from two side edges of the plate body portion 61, then bends downward and extends to be located at two sides of the heightening portion 11 and elastically urges against the second baffle 314 of the second shielding casing 31 so as to enhance a grounding effect of the electrical connector 100.

Two sides of the bottom end of the extending portion 62 respectively extend backward to form soldering legs 622 in an SMT type. The two soldering legs 622 are respectively located at the outer side of the soldering portions 203 of the two ground terminals 21, and the soldering legs 622 are adjacent to the soldering portions 203 of the upper ground terminals 21. Therefore, the soldering portions 203 of the ground terminals 21 are soldered to a same ground soldering pad (not shown) on the circuit board 7.

In certain embodiments, two side edges of the plate body portion 61 are respectively provided with protrusions 614 corresponding to the shielding cover 5 and protruding out of the tongue 12. The protrusions 614 urge against the combination location of the buckling portions 501 and 501' of the first shielding cover 50 and the second shielding cover 50', thus realizing electrical connection between the shielding sheet 6 and the shielding cover 5.

In conclusion, certain embodiments of the electrical connector 100 of the present invention, among other things, have the following beneficial advantages.

1. The front end and middle section 202 of the same ground terminal 21 are respectively provided with the first contacting portion 211 and the second contacting portion 212 which electrically contact with the shielding sheet 6, so that a plurality of signal return paths are formed between the ground terminal 21 and the shielding sheet 6, an interference signal of a differential signal terminal pair beside the ground terminal 21 is fully conducted to a grounding path on the circuit board 7 by a plurality of circulation paths between the ground terminal 21 and the shielding sheet 6, a grounding effect of the electrical connector 100 is enhanced, and a high frequency performance of the electrical connector is improved. In addition, the shielding sheet 6 contacts with the front end of each ground terminal 21, when the signal is transmitted to the electrical connector 100 from the mating connector, noise and crosstalk can be conducted to the shielding sheet 6 at the front end of the ground terminal 21 and is further conducted to the grounding path on the circuit board 7 by the shielding sheet 6, and the grounding effect is further improved.

2. The first urging portion 610, the second urging portion 611 and the third urging portion 621 are punctured from the shielding sheet 6 of a metal plate material to form a cantilever shape, and are convenient for machining and molding, and contact between each urging portion and the corresponding ground terminals 21 and 21' is plate surface contact, thus enlarging a contact area and ensuring a good grounding effect.

3. Due to the soldering legs 622 extending from the rear end of the shielding sheet 6, the shielding sheet 6 can directly self-conduct the crosstalk to the grounding path of the circuit board 7. The soldering legs 622 are disposed close to the soldering portions 203 of the ground terminals 21, so that the soldering legs 622 and the corresponding soldering portions 203 of the grounding terminals 21 can be soldered to a same soldering pad on the circuit board 7 together.

4. The bottom wall 301 integrally bends downward and extends to form a shielding plate 304 which is located in front of the heightening portion 11 and partially shields the heightening portion 11; the second top wall 312 integrally bends to form a rear cover 311 which is located behind the heightening portion 11 and at least partially shields the heightening portion 11, so that the middle sections are disposed between the shielding plate 304 and the rear cover 311. In addition, the two side walls 303 and the second side walls 313 are provided with the first baffles 305 and the second baffles 314 which are located at two sides of the heightening portion 11 respectively, and the shielding plate 304, the rear cover 311, the first baffles 305 and the second baffles 314 encircle the middle sections therein, so that the middle sections are isolated from an external environment and the electrical connector 100 is free of influence of electro-magnetic interference (EMI) when a high frequency signal is transmitted, thus improving a high frequency transmission performance of the electrical connector 100.

5. Two side edges of the plate body portion 61 respectively extend to form first pressing portions 612 and second pressing portions 613, and the first pressing portions 612 protrude from the base 10 and respectively abut against the first side wall 303 of the first shielding casing 30; the second urging portions 613 firstly extend backward to the base 10 from two side edges of the plate body portion 61, then bend downward and extend to be located at two sides of the heightening portion 11 and respectively elastically abut against the second baffles 314 of the second shielding casing 31 so as to enhance a grounding effect of the electrical connector 100.

6. Two sides of the first shielding cover 50 are transversely provided with two elastic pieces 503, the portion of the tongue 12 close to the base 10 is provided with avoiding slots 121 corresponding to the elastic pieces 503, the ground terminals 21 and 21' are partially exposed out of the avoiding slots 121, the elastic pieces 503 urge against the ground terminals 21 and 21' via the avoiding slots 121 so as to be grounded, thus enhancing a shielding effect of the electrical connector 100 and improving its high frequency transmission quality.

7. Two side edges of the plate body portion 61 are respectively provided with protrusions 614 corresponding to the shielding cover 5 and protruding out of the tongue 12, the protrusions 614 abut against the combination location of the buckling portions 501 and 501' of the first shielding cover 50 and the second shielding cover 50', thus realizing electrical connection between the shielding sheet 6 and the shielding cover 5.

8. A cushion block 4 is disposed below the bottom wall 301, the cushion block 4 corresponds to the heightening portion 11 to fill a gap below the plug interface 306, above the circuit board 7 and in front of the heightening portion 11, so that the electrical connector is prevented from forwards tilting due to plugging and unplugging for many times, and a service life is prolonged.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body;

a shielding sheet disposed in the insulating body; and a ground terminal received in the insulating body for mating with a mating connector, and fixed between a plate surface of the shielding sheet and the insulating body, wherein the ground terminal comprises a front end, a middle section, and a rear end having a soldering portion; and wherein a first contacting portion is disposed at the front end, a second contacting portion is disposed at the middle section, and the first contacting portion and the second contacting portion respectively electrically contact with the shielding sheet.

2. The electrical connector of claim 1, wherein a first urging portion and a second urging portion extend from the shielding sheet toward the ground terminal, and respectively urge against the first contacting portion and the second contacting portion.

3. The electrical connector of claim 2, wherein the middle section of the ground terminal has a horizontal segment and a vertical segment perpendicular to each other and connected to each other, a number of the second contacting portion is two, and each of the horizontal segment and the vertical segment is provided with one of the two second contacting portions;

the shielding sheet has a plate body portion and an extending portion that are parallel with the horizontal segment and the vertical segment respectively, a number of the second urging portion is two, and each of the plate body portion and the extending portion are respectively provided with one of the two second urging portions correspondingly urging against the two second contacting portions on the horizontal segment and the vertical segment.

4. The electrical connector of claim 2, wherein the shielding sheet is formed by punching a metal plate material, the first urging portion and the second urging portion each form a cantilever shape by puncturing the metal plate material, and the first urging portion and the second urging portion are in corresponding plate surface contact with the first contacting portion and the second contacting portion.

5. The electrical connector of claim 1, wherein a soldering leg extends from a back end of the shielding sheet and is adjacent to the soldering portion of the ground terminal.

6. The electrical connector of claim 1, wherein the terminals form a row of terminals disposed above or below the plate surface of the shielding sheet, two terminals located at the outermost side in the row of terminals are ground terminals, and the shielding sheet correspondingly urges against the first contacting portion and the second contacting portion of each of the ground terminals.

7. The electrical connector of claim 6, wherein there are two soldering legs extending from the back end of the shielding sheet, and the two soldering legs are respectively located at the outer sides of the soldering portions of the two ground terminals.

8. The electrical connector of claim 1, wherein the terminals include an upper row of terminals and a lower row of terminals, the shielding sheet is located between the upper row of terminals and the lower row of terminals, each row of terminals is provided with the ground terminal, the front end and the middle section of the ground terminal in the upper row of terminals are respectively provided with a first contacting portion and a second contacting portion, and the first contacting portion and the second contacting portion electrically contact with the shielding sheet.

9. The electrical connector of claim 8, wherein the middle section of the ground terminal in the lower row of terminals is provided with a third contacting portion electrically contacting with the shielding sheet.

10. The electrical connector of claim 9, wherein the middle section of the ground terminal in the upper row of terminals is provided with two second contacting portions, the shielding sheet extends two second urging portions respectively contacting with the two second contacting portions, the shielding sheet further includes a third urging portion urging against the third contacting portion, and the third urging portion is located between the two second urging portions.

* * * * *